United States Patent [19]

Hodge

[11] 4,105,180

[45] Aug. 8, 1978

[54] MOUNTING BRACKET FOR A NEWSPAPER DELIVERY BOX

[76] Inventor: Joel W. Hodge, 208 Riverview Ct., Elizabethton, Tenn. 37643

[21] Appl. No.: 810,562

[22] Filed: Jun. 27, 1977

[51] Int. Cl.[2] ..... A47G 29/00

[52] U.S. Cl. ..... 248/300; 232/39; 232/1 C

[58] Field of Search ..... 248/218.1, 146, 150, 248/152, 300, 360; 232/17, 38, 39, 1

[56] References Cited

U.S. PATENT DOCUMENTS

| | | | |
|---|---|---|---|
| 519,427 | 5/1894 | Groff | 232/39 |
| 697,450 | 4/1902 | Corbin | 232/39 |
| 720,279 | 2/1903 | Norton | 232/39 |
| 1,504,514 | 8/1924 | Ryther | 232/17 |
| 2,120,857 | 6/1938 | Crawford et al. | 232/1 C |
| 3,022,033 | 2/1962 | Flower | 248/300 |

*Primary Examiner*—Roy D. Frazier
*Assistant Examiner*—Peter A. Aschenbrenner
*Attorney, Agent, or Firm*—R. Laddie Taylor

[57] ABSTRACT

A bracket for mounting a newspaper delivery box or the like to a support structure comprises an elongated rectangular base having a single corrugation formed therein, the corrugation having means for mounting the bracket to the support structure. Preferably, means are provided for bracing the bracket to the support structure and an arm is provided to supply additional support to a box mounted thereon.

2 Claims, 4 Drawing Figures

MOUNTING BRACKET FOR A NEWSPAPER DELIVERY BOX

BACKGROUND OF THE INVENTION

Boxes such as newspaper delivery boxes are conventionally attached to a support structure by mounting the bottom of the box directly over the support structure using mounting means designed for such a purpose. Alternately, the box is attached to the support structure by passing screws or the like directly through the support structure and one side wall of the box. While these procedures are satisfactory for some purposes, several disadvantages are present.

Conventional devices for attaching such a box to a support structure do not provide a secure and stable means for supporting the box. A newspaper box, in common use, has considerable stress exerted thereon and through the box to the mounting means. Often, such mounting means are found to be bent or broken as a result of constant usage. Additionally, vandalism on the box, such as twisting and turning of the box on its support structure, results in severe permanent damage to the box and support structure and greatly limits further use of either device.

SUMMARY OF THE INVENTION

This invention, which overcomes the disadvantages of prior art mounting means for newspaper boxes and the like, comprises an elongated rectangular base having a single rectangularly shaped corrugation formed therein, the corrugation having at least two holes therein for securing the bracket to a support structure. Preferably, means are provided for bracing the bracket to the support structure and an arm is provided to supply additional support to a box mounted thereon.

BRIEF DESCRIPTION OF THE DRAWINGS

The invention will become more apparent when described in conjunction with the drawings, in which like reference numbers designate like parts in the different FIGS., and wherein.

DESCRIPTION OF THE PREFERRED EMBODIMENTS

Figure 1:
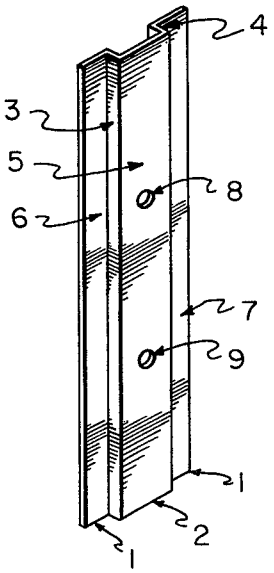
FIG. 1 is a perspective view of one embodiment of the mounting bracket of the present invention.

Referring now to FIG. 1, a mounting bracket for mounting a box to a support structure and adapted to be attached to the support structure comprises an elongated rectangular base 1 having a single rectangularly shaped corrugation 2 (i.e., sides 3 and 4 of the corrugation 2 are perpendicular to the rectangular base 1 of the bracket and are also perpendicular to the face 5 of the corrugation 2) formed therein along the center of the rectangular base 1 and parallel to the elongated sides 6 and 7 thereof, the face 5 of the corrugation 2 having at least two holes 8 and 9 therein, these holes lying along the midline between the elongated sides of the corrugation 2, for receiving bolts or the like to secure the bracket to the support structure.

The corrugation provides an opening between the box and the location where the support structure is attached to the bracket to allow insertion of bolts or the like of appropriate length to provide means for attaching the support structure to the box without requiring undesirable holes through the walls of the box.

In a preferred embodiment of the invention, the length of the mounting bracket is equal to the height of the side walls of a standard newspaper delivery box, conventionally approximately 6.75 inches, the width of the corrugation is approximately 1.25 inches, and the height of the corrugation from the base is approximately 0.25 inches.

Figure 2:
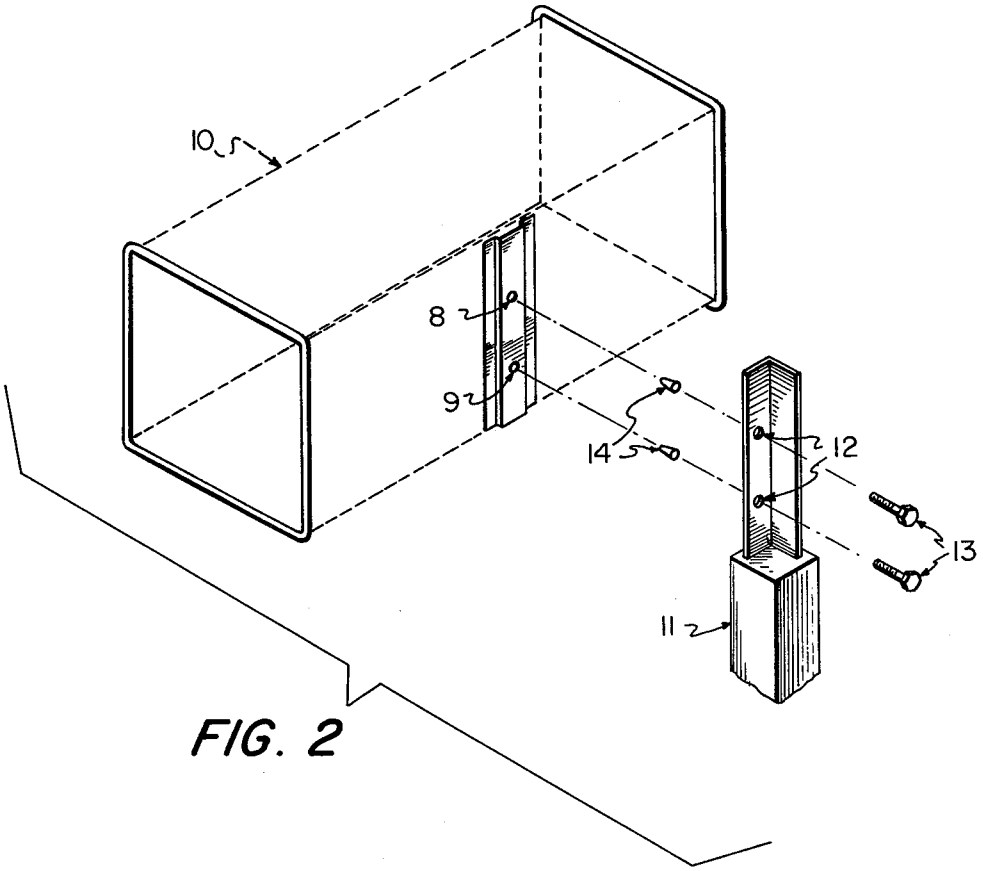
FIG. 2 is a perspective view showing the mounting bracket of FIG. 1 attached to a box and illustrating a method of mounting the bracket - box assembly to a support structure.

In FIG. 2, the mounting bracket of FIG. 1 is shown attached to a conventional newspaper delivery box 10. The mounting bracket may be attached to a support structure 11, which is shown for illustration purposes only in FIG. 2 and FIG. 4 as a wooden post having a length of angle iron extending therefrom, by passing bolts or the like of appropriate size through holes 12 of the support structure 11 and the holes 8 and 9 provided in the mounting bracket.

Although any type of bolts or the like of appropriate size may be used to attach the mounting bracket to the support structure, shear bolts 13 are illustrated as exemplary means for use in conjunction with self-tapping inserts 14. These inserts are placed in holes 8 and 9 of the mounting bracket and the shear bolts 13 are passed through the holes 12 in the support structure 11 and holes 8 and 9 of the mounting bracket and screwed into the inserts 14 contained in the holes of the bracket. If a newspaper delivery box-support structure utilizing the support bracket of this invention and the shear bolt assembly were disturbed, such as by vandals, serious damage to the box and the support structure would be prevented by the shearing of the bolts.

Figure 3:
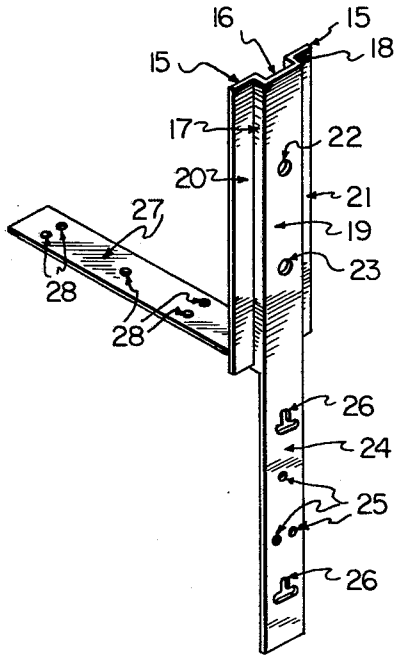
FIG. 3 is a perspective view of a second embodiment of the mounting bracket of the present invention.

FIG. 3 illustrates a second embodiment of a mounting bracket for mounting a box such as a newspaper delivery box to a support structure and adapted to be attached to the support structure comprising an elongated rectangular base 15 having a single rectangularly shaped corrugation 16 (i.e., the sides 17 and 18 of the corrugation 16 are perpendicular to the rectangular base 15 of the bracket and are also perpendicular to the face 19 of the corrugation 16) formed therein along the center of the rectangular base 15 and parallel to the elongated sides 20 and 21 thereof, the face 19 of the corrugation 16 having at least two holes 22 and 23 therein, these holes lying along the midline between the elongated sides of the corrugation 16, for receiving bolts or the like to secure the bracket to the support structure, wherein the face 19 of the corrugation 16 is extended from the rectangular base 15 to form leg 24 having a length sufficient to provide additional means for securing and bracing the bracket to the support structure, the means comprising, for example, holes 25 and at least one, and preferably two, "T" slots 26, and an arm 27 provided at the location where the face 19 of the corrugation 16 is extended from the rectangular base 15 to form leg 24, the arm being positioned in perpendicular relationship to the length of face 19 of corrugation 16, for supporting the bottom of a box mounted thereon. Holes 28 may optionally be provided in arm 27 to receive additional mounting means such as bolts or the like if required.

The corrugation provides an opening between the box and the location where the support structure is attached to the bracket to allow insertion of bolts or the like of appropriate length to provide means for attaching the support structure to the box without requiring undesirable holes through the walls of the box.

In a preferred embodiment of the invention, the length of the base of the mounting bracket is equal to the height of the side wall of a standard newspaper delivery box, conventionally approximately 6.75 inches, the width of the base of the bracket is approximately 2.5 inches, the width of the corrugation and the leg extended therefrom is approximately 1.25 inches, the height of the corrugation from the base is approximately 0.25 inches, the length of the extended portion of the corrugation which forms the leg having additional mounting means is 9.25 inches, the length of the arm extended perpendicularly from the location where the face of the corrugation is extended from the rectangular base is equal to the width of the box mounted thereon, in the case of a conventional newspaper delivery box approximately 7.50 inches, and the width of the arm is approximately 1.25 inches.

Figure 4:
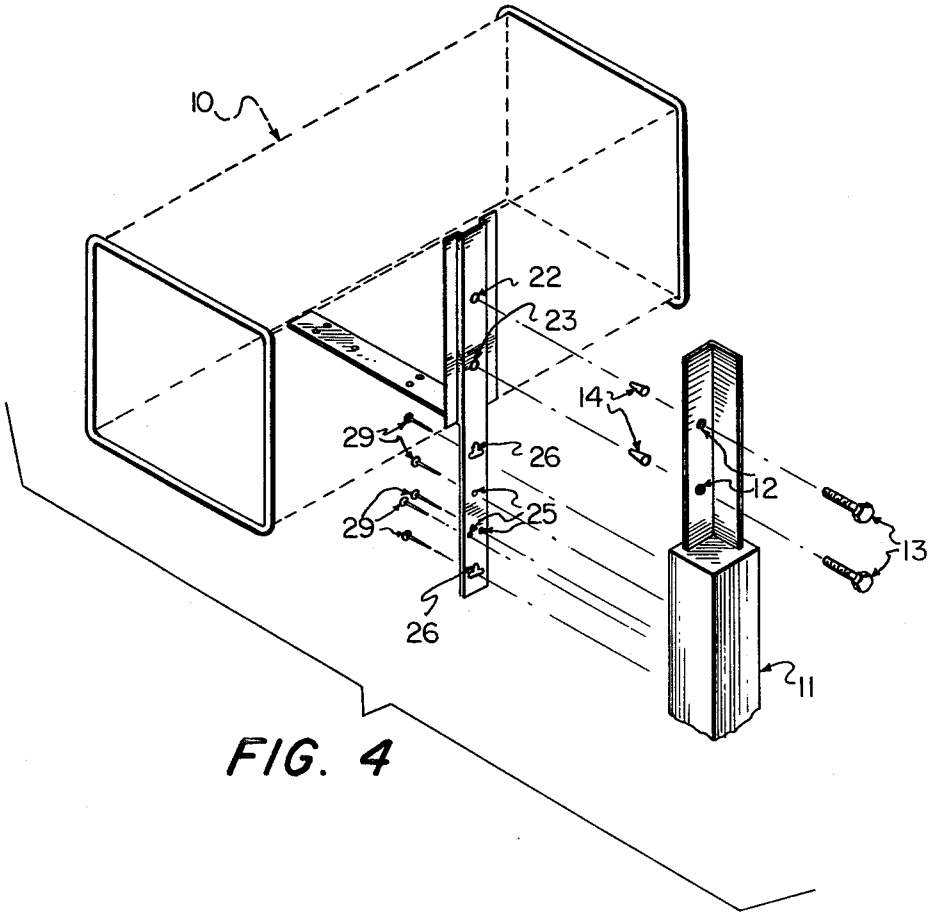
FIG. 4 is a perspective view showing the mounting bracket of FIG. 3 attached to a box and illustrating a method of mounting the bracket - box assembly to a support structure.

In FIG. 4, the mounting bracket of FIG. 3 is shown attached to a conventional newspaper delivery box 10. The mounting bracket may be attached to a support structure 11, described above, by passing bolts or the like through holes 12 of the support structure 11 and the holes 22 and 23 provided in the corrugation of the mounting bracket. Preferably, however, shear bolts 13 are used in conjunction with self-tapping inserts 14 as described in detail above.

Nails 29, screws or the like may be inserted through holes 25 and "T" slots 26 and into support structure 11 to provide additional support and bracing for the bracket. The design of the "T" slots allows horizontal adjustment of the box after screws or the like have been inserted therethrough and into the support structure before final tightening.

The mounting bracket is preferably fabricated of a metal, such as 12 to 16 gauge rolled steel, or of plastic, and may be attached to a box by methods well known in the art, such as by welding in the case of a metal box, or by stamping or molding as a component of a complete box from material such as plastic.

While the invention has been described in detail with reference to the drawings and specific embodiments thereof, it will be apparent to one skilled in the art that various changes and modifications can be made therein without departing from the scope and spirit thereof, and, therefore, the invention is not intended to be limited except as indicated in the appended claims.

I claim:

1. A mounting bracket for mounting a box to a support structure and adapted to be attached to the support structure, said bracket comprising an elongated rectangular base having a single rectangularly shaped corrugation formed therein along the center of said rectangular base and parallel to the elongated sides thereof, said corrugation having at least two holes therein for securing the bracket to the support structure, wherein the face of said corrugation is extended from the rectangular base to form a leg having a length sufficient to provide additional means for securing the bracing the bracket to the support structure, and an arm provided at the location where said face of the corrugation is extended from said rectangular base, said arm being positioned in perpendicular relationship to the length of the extended face of the corrugation, for supporting the bottom of a box mounted thereon.

2. The mounting bracket of claim 1 wherein the leg formed by extending the face of the corrugation from the rectangular base has at least one "T" slot formed therein.

* * * * *